US008695161B2

(12) United States Patent
Williams

(10) Patent No.: US 8,695,161 B2
(45) Date of Patent: Apr. 15, 2014

(54) VACUUM MOTOR SCROLL ASSEMBLY AND VACUUMS INCLUDING SUCH AN ASSEMBLY

(75) Inventor: Matthew A. Williams, Bridgeton, MO (US)

(73) Assignee: Emerson Electric Co., St. Louis, MO (US)

( * ) Notice: Subject to any disclaimer, the term of this patent is extended or adjusted under 35 U.S.C. 154(b) by 218 days.

(21) Appl. No.: 13/421,654

(22) Filed: Mar. 15, 2012

(65) Prior Publication Data

US 2012/0233805 A1 Sep. 20, 2012

Related U.S. Application Data

(60) Provisional application No. 61/452,752, filed on Mar. 15, 2011.

(51) Int. Cl.
*A47L 9/22* (2006.01)
*A47L 9/00* (2006.01)

(52) U.S. Cl.
CPC . *A47L 9/22* (2013.01); *A47L 9/0081* (2013.01)
USPC ..... 15/412; 15/347; 15/326

(58) Field of Classification Search
CPC ..... A47L 5/36; A47L 5/365; A47L 9/0081; A47L 9/22
USPC ..... 15/327.2, 327.6, 347, 352, 353, 412
IPC ..... A47L 9/00,9/22
See application file for complete search history.

(56) References Cited

U.S. PATENT DOCUMENTS

| | | | | |
|---|---|---|---|---|
| 6,101,669 | A * | 8/2000 | Martin et al. | 15/327.2 |
| 6,175,988 | B1 * | 1/2001 | White et al. | 15/327.1 |
| 6,987,338 | B1 * | 1/2006 | Lavasser et al. | 310/71 |
| 8,418,312 | B2 * | 4/2013 | Rhea et al. | 15/330 |

* cited by examiner

*Primary Examiner* — David Redding
(74) *Attorney, Agent, or Firm* — Sutton McAughan Deaver, PLLC

(57) ABSTRACT

A scroll assembly for use with a fluid machine, such as a wet/dry vacuum appliance, is described. Such scroll assembly may include a base portion, a cover portion configured to couple to the base portion, and a cavity between the base portion and the cover portion, wherein the cover portion and the base portion collectively form a labyrinth seal when coupled together, and wherein the labyrinth seal at least partially circumscribes the cavity. A vacuum appliance may include a scroll assembly coupled at least partially therein. A method of exhausting air from a vacuum appliance may include energizing a vacuum motor, thereby drawing air into the scroll assembly, allowing the air to contact a flow splitter, and allowing the air to exit the vacuum appliance.

19 Claims, 10 Drawing Sheets

VACUUM MOTOR SCROLL ASSEMBLY AND VACUUMS INCLUDING SUCH AN ASSEMBLY

CROSS REFERENCE TO RELATED APPLICATIONS

This application claims priority to U.S. Provisional Patent Application Ser. No. 61/452,752, filed Mar. 15, 2011, and incorporated herein by reference in its entirety.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The invention disclosed and taught herein relates generally to encased, electric motor driven devices, and more specifically is related to a protective motor scroll assembly for use with a fluid machine, such as a vacuum appliance, having an internal electric motor.

2. Description of the Related Art

The invention disclosed and taught herein is directed to an improved motor scroll assembly for a fluid machine. Although this invention can be used in numerous applications, it will be disclosed in one of many applications for illustrative purposes.

Typically, when a vacuum appliance, such as a wet/dry or work area vacuum cleaner, is switched "on", the vacuum motor is energized, which in turn rotates a blower wheel. The rotating of the blower wheel generates a vacuum within the vacuum collection drum. There is typically a filter, among other components, interfaced between the blower wheel and the collection drum. When a hose, or other such attachment is coupled to the drum, the vacuum will cause air, dirt, liquids, and/or other media or debris to be drawn from a dirty surface into the collection drum. As this "dirty" air enters the drum, some of the media particles fall to the bottom of the drum, while other media, typically the finer media particles, may contact the vacuum filter. The filter traps at least a majority of the particulate media, thus preventing it from being drawn out of the drum, and exhausted back into the atmosphere of the work area. The filtered air then typically flows into a motor scroll housing that houses the blower wheel, whereafter it is generally exhausted into the atmosphere surrounding the vacuum appliance via an exit port. The motor scroll housing, or motor scroll, typically exists atop the lid of the vacuum appliance and includes a cavity that contains the blower wheel, wherein the blower wheel spins to draw air from the drum to create a vacuum in the system. The motor scroll housing typically includes two or more components coupled together with one or more seals or gaskets to ensure a proper vacuum is maintained within the system by preventing unwanted fluid communication between the motor scroll cavity and the atmosphere. However, because the motor scroll housing is located outside the drum, air can escape into the atmosphere if one or more of the seals fails.

While each of these systems may be useful in certain limited applications, it can be seen that there is a need for an improved motor scroll that inverts the standard collector scroll seal to the waste drum side of the system to provide a fail-safe seal and that can eliminate the need for additional gaskets.

The invention disclosed and taught herein is directed to an improved motor scroll assembly and method for housing an impeller assembly and exhausting air from a fluid machine, such as a wet/dry vacuum cleaner, using such an assembly.

BRIEF SUMMARY OF THE INVENTION

A scroll assembly for a vacuum appliance, such as a wet/dry vacuum cleaner, is described herein. In accordance with an aspect of the present disclosure, the scroll assembly may include a lower base portion having an opening, an upper cover portion having an air inlet and configured to couple to the base portion, and a cavity in between the base portion and the cover portion, wherein the cover portion and the base portion collectively form a labyrinth seal when the cover portion and the base portion are coupled together, and wherein the labyrinth seal at least partially circumscribes the cavity.

In accordance with another aspect of the present disclosure, a vacuum appliance having an improved scroll assembly is described. Such a vacuum appliance includes a lid adapted to removably couple to a collection drum, the lid having an interior side, an exterior side, and an exhaust port; a scroll assembly coupled to the interior side of the lid so that the air inlet is in fluid communication with the exhaust port; and a vacuum motor coupled to the lid, wherein the vacuum motor has an impeller assembly disposed at least partially within the scroll assembly.

In accordance with further aspects of the present disclosure, a method of exhausting air from a vacuum appliance having a lid adapted to couple to a collection drum is described, wherein the lid has an interior side, an exterior side, and an exhaust port, and a scroll assembly is coupled to the interior side of the lid so that an air inlet is in fluid communication with the exhaust port. In accordance with this aspect, a vacuum motor is coupled to the lid, the vacuum motor having an impeller assembly disposed at least partially within the scroll assembly, and a flow splitter is fluidicly disposed between the air inlet and the exhaust port, wherein the method includes energizing the vacuum motor, thereby drawing air through the air inlet and into the scroll assembly, allowing the air to contact the flow splitter, thereby distributing the air into at least one flow path, and allowing the air to exit the vacuum appliance through the exhaust port.

In accordance with yet another aspect of the present disclosure, a vacuum appliance, such as a wet/dry vacuum cleaner, is described, the vacuum appliance comprising a collection drum having at least one side, a base, and an open top; a motor operable to create a vacuum in the collection drum; a lid removably attached to the open top of the collection drum, the lid having a motor mount member with the motor attached thereto, and a scroll assembly attached to the lid. The scroll assembly comprises a base portion having an opening formed there through, and a cover portion having an air inlet and configured to couple to the base portion, thereby defining a cavity between the base portion and the cover portion. The cover portion and the base portion collectively form a labyrinth seal when the cover portion and the base portion are coupled together, such that the labyrinth seal at least partially circumscribes the cavity.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
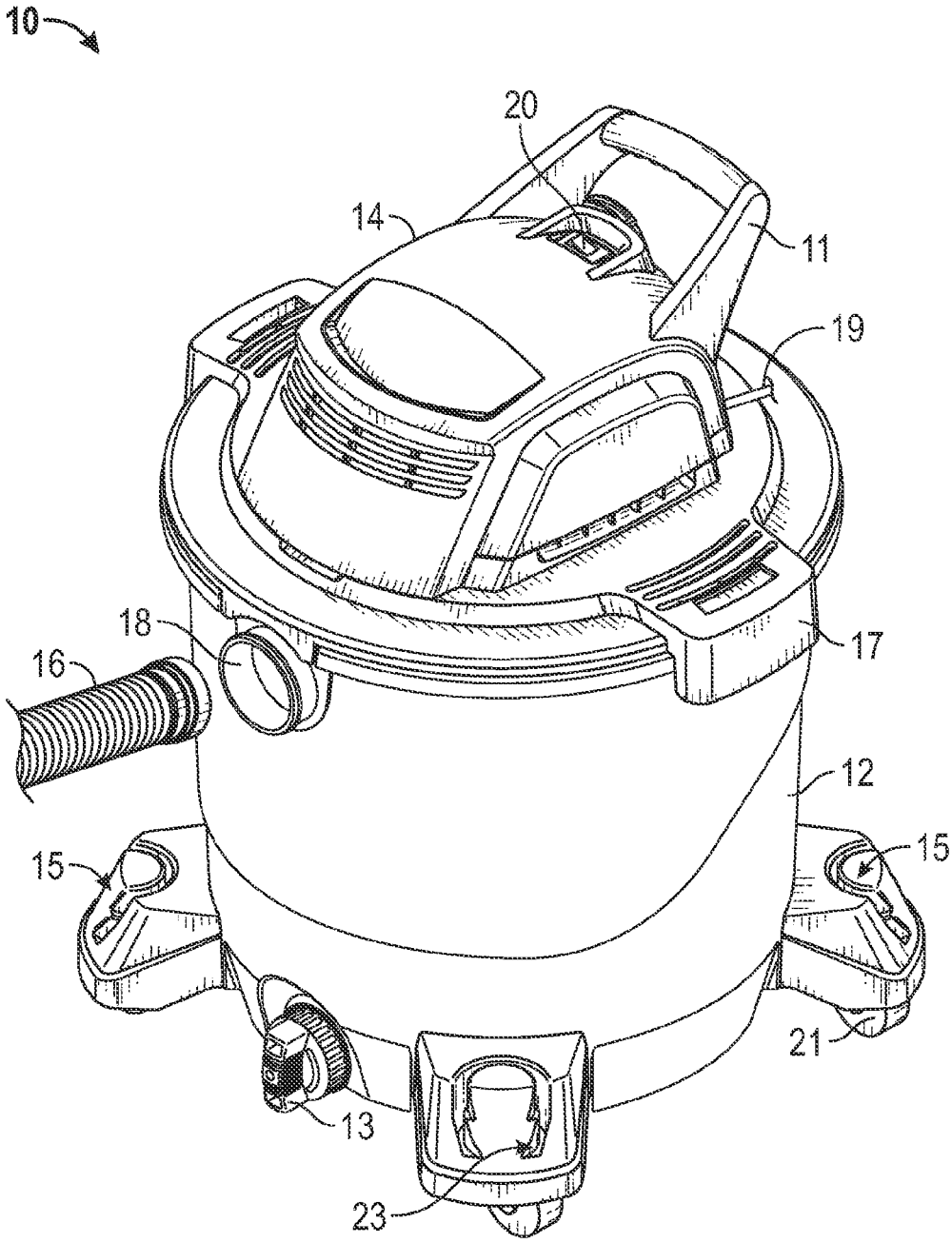
FIG. 1 illustrates a perspective view of one of many exemplary vacuum cleaners in accordance with the present disclosure.

While the invention disclosed herein is susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above and the written description of specific structures and functions below are not presented to limit the scope of what Applicant has invented or the scope of the appended claims. Rather, the Figures and written description are provided to teach any person skilled in the art to make and use the invention for which patent protection is sought. Those skilled in the art will appreciate that not all features of a commercial embodiment of the invention are described or shown for the sake of clarity and understanding. Persons of skill in this art will also appreciate that the development of an actual commercial embodiment incorporating aspects of the present invention will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having the benefits of this disclosure. It must be understood that the invention disclosed and taught herein is susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. The terms "couple," "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and can further include without limitation integrally forming one functional member with another in a unity fashion. The coupling can occur in any direction, including rotationally.

Applicant has created an improved motor scroll assembly for use with a fluid machine, such as a wet/dry vacuum cleaner. A scroll assembly in accordance with the present disclosure, and as will be described in more detail herein, may include two or more portions configured to be sealingly coupled together forming a cavity there between for housing at least a portion of a vacuum motor. Each portion may include one or more (a plurality of) ribs and/or one or more channels or grooves formed therein. At least one rib may further have a complementary groove, which may act to form a labyrinth seal when the sections of the scroll assembly are coupled together. A scroll assembly in accordance with the present disclosure may also optionally, but need not, include sound deadening structures, such as a liner or flow splitter.

Turning now to the Figures, FIG. 1 is a perspective view of one of many exemplary wet/dry vacuum cleaners 10 in accordance with the present disclosure which houses a motor scroll assembly (not shown) of the invention within the lid assembly, as described in more depth herein. The vacuum 10 comprises a collection drum 12, (equivalently referred to herein as a collection canister or vacuum body), having a bottom, sides, and an open top, and having a powerhead 14 (or a lid that is integrally formed with the powerhead) releasably secured via one or more securement latches 17 to, and over the open top of, collection drum 12. The powerhead 14 isolates a motor 104 (see, FIG. 2) from the drum 12 to prevent contamination from liquid and debris entering the vacuum during normal operation. As is known with wet/dry vacuums and similar vacuum appliances, motor 104 attached within powerhead 14 is operable to create a vacuum inside the collection drum 12 through a vacuum inlet port, 18. Collection drum 12, while shown to be cylindrical in shape for general discussion, is not limited to such a form, and may also be oval, square, rectangular, or any number of other suitable shapes, in a variety of sizes ranging from only a few gallons (e.g., 4 gallons) to more than 10 gallons in capacity, without limitation. The vacuum 10 may be battery powered, or more typically, powered via AC or DC electricity by way of power cord 19. The collection drum 12 may also include a plurality of caster foot assemblies 15 coupled to the bottom portion of the drum, wherein the casters 15 include a caster housing or foot, each housing or foot further containing a caster 21. Caster assemblies 15 may be removable or permanently fixed as appropriate for the particular vacuum appliance and its intended applications. Casters 21 facilitate movement of the vacuum appliance 10 at the convenience of an operator. As shown in the figure, the caster foot assemblies 15 may optionally include vacuum accessory securing posts 21 formed on the top face thereof. While not shown in the figure, it is envisioned that the drum may also be connected to two caster foot assemblies 15 and a wheel assembly having a pair of wheels.

As further illustrated in FIG. 1, collection drum 12 may also optionally include a drain and drain plug 13 at the bottom wall of the drum itself, for ease of draining liquid debris from the drum, for ease in cleaning the drum once the powerhead 14 has been removed, for emptying liquid from the collection drum 12 without having to remove the lid, or for attachment to a vacuum pump accessory (such as described in U.S. Design Pat. No. D551,681) to aid in the removal of liquid debris from within the drum 12. Powerhead 14 typically can also include a handle means 11 formed onto or into it, as appropriate, and houses a motor and impeller (or blower wheel) assembly (further described below) for establishing vacuum pressure within the vacuum 10 when a power actuating switch 20 is engaged. A flexible vacuum hose 16 may be configured so that one end can be inserted into a vacuum inlet 18 formed drum 12 (or, alternatively and equivalently, in powerhead 14) and in fluid connection with powerhead 14 within the vacuum itself. In one embodiment of the present disclosure, hose 16 is simply friction-fitted into inlet 18. Similarly and equally acceptable, hose 16 may be lock-fitted into inlet 18, as appropriate.

For purposes of clarity and understanding, one or more of these components may not be specifically described or shown below while, nevertheless, being present in one or more embodiments of the invention, such as in a commercial embodiment, as will be readily understood by one of ordinary skill in the art.

Figure 2:
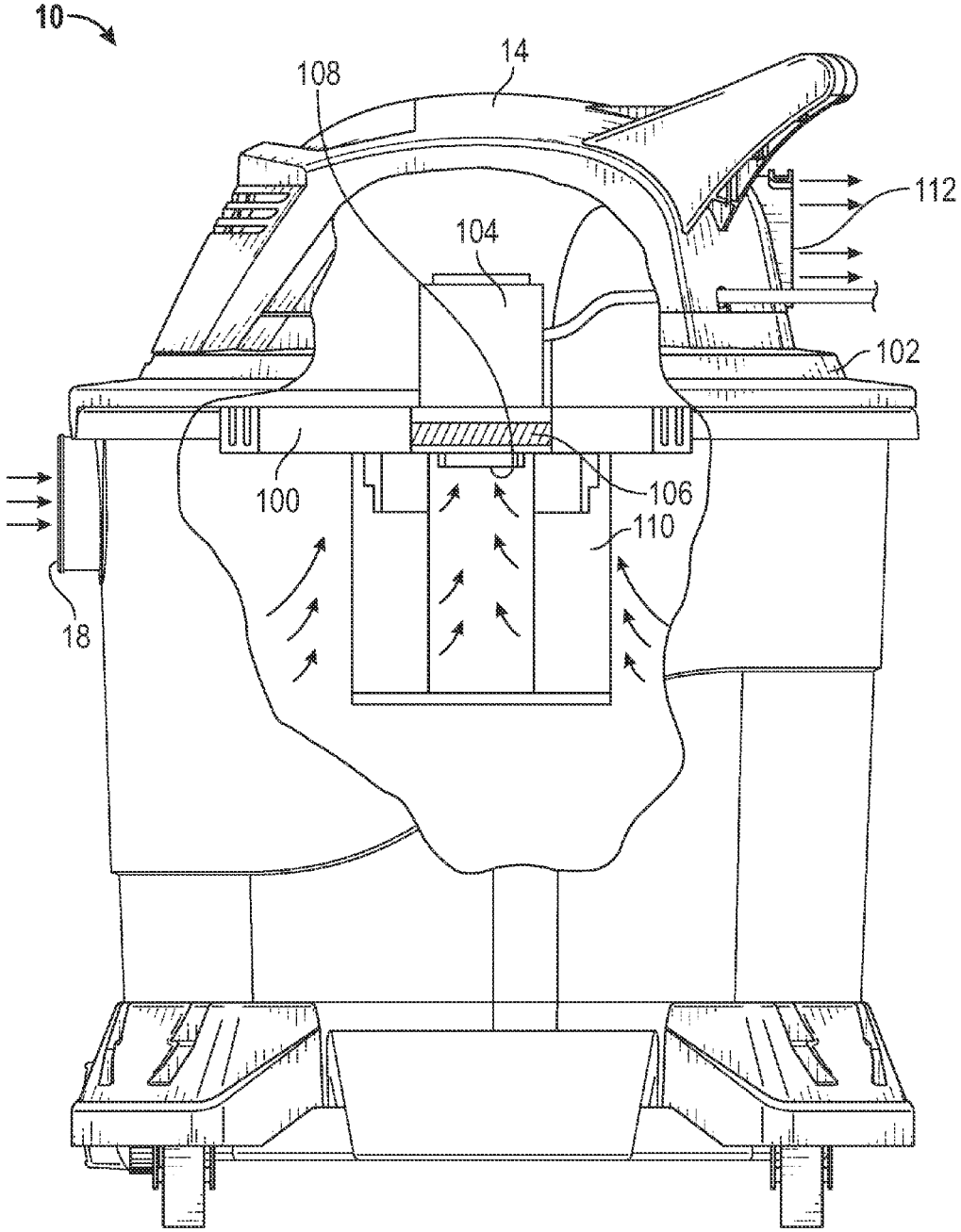
FIG. 2 illustrates a side view of the vacuum cleaner of FIG. 1, with a partial cut-away of the interior of the vacuum.

FIG. 2 is a partial cross-sectional side view of the vacuum cleaner 10 of FIG. 1 in accordance with the present disclosure. Vacuum cleaner 10 may include a scroll assembly 100, which is the focus of the present invention and which is described in further detail below. Scroll assembly 100 may be coupled to lid 102 or powerhead 14, separately or in combination, including being formed integrally therewith, in whole or in part. Scroll assembly 100 may at least partially support motor 104, for example, by housing impeller assembly 106 or one or more other components of motor 104, as will be understood by one of ordinary skill. Scroll assembly 100 may include an air inlet 108, which may be in fluid communication with a filter assembly 110 that may include a filter cage and a pleated filter fitted over the cage, for example, through which motor 104 may draw air during vacuuming operations. When motor 104 is energized, in vacuum mode, for example, air typically may flow into drum 12 through vacuum inlet port 18, through filter assembly 110, and into scroll assembly 100 through air inlet 108, before being exhausted back into an atmosphere surrounding vacuum cleaner 10, such as through exhaust port 112 formed into the powerhead assembly 14. This vacuum air flow pattern is illustrated generally by the arrows in FIG. 2.

Figure 3:
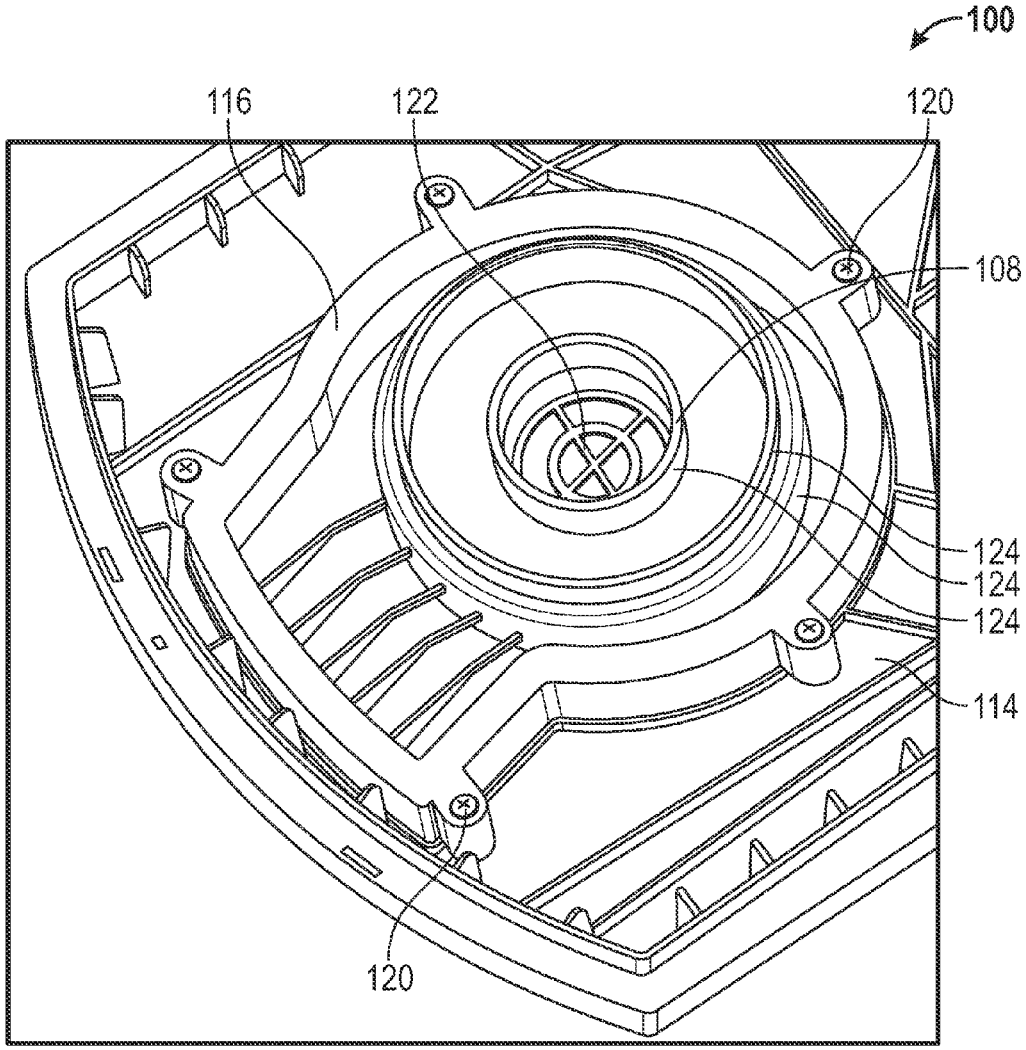
FIG. 3 illustrates an isometric bottom view of one of an exemplary scroll assembly in accordance with the present disclosure.

FIG. 3 illustrates an isometric bottom view of one of many embodiments of a scroll assembly 100 in accordance with the present disclosure. Scroll assembly 100 may include one or more components for forming a scroll cavity (further described below). For example, scroll base 114 and scroll cover 116 may be configured to sealingly couple to one another to define a space or void, such as a shaped cavity 118, in between (see, e.g., FIG. 4). Base 114 and cover 116 may be coupled removably or otherwise, in whole or in part, and may preferably sealingly communicate along at least a portion of their outer peripheries, as further described below. Base 114 and cover 116 may be coupled in any manner required by a particular application, which may, but need not include the use of one or more fasteners 120, such as assembly screws, bolts, clips, adhesives, or other fasteners, separately or in combination. Base 114 may, but need not, be coupled to a face of a lid 102 (see, e.g., FIG. 2), or in whole or in part, including being formed integrally there with. Cover 116 may further include air inlet 108, for example, for allowing air to enter cavity 118. Inlet 108 may also, but need not, include a blower guard, such as guard 122, for protecting one or more components of the system, for example, by at least partially preventing debris from entering cavity 118. Scroll cover 116 may also include one or more structures or structural features for communicating with one or more other components of the system, for example, coupling structure 124, which may include ribs, seals, gaskets or other structure, for communicating with a filter assembly 110 (not shown) coupled in fluid communication with air inlet 108. Base 114 and cover 116 may be formed from any material required by a particular application, such as metal, composite, polymeric materials such as blown or extruded polypropylene, alloys or another material, in whole or in part, and may preferably be formed from plastic or a polymeric material having a wall thickness appropriate for the application of the vacuum appliance (e.g., about 0.100 inch).

Figure 4:
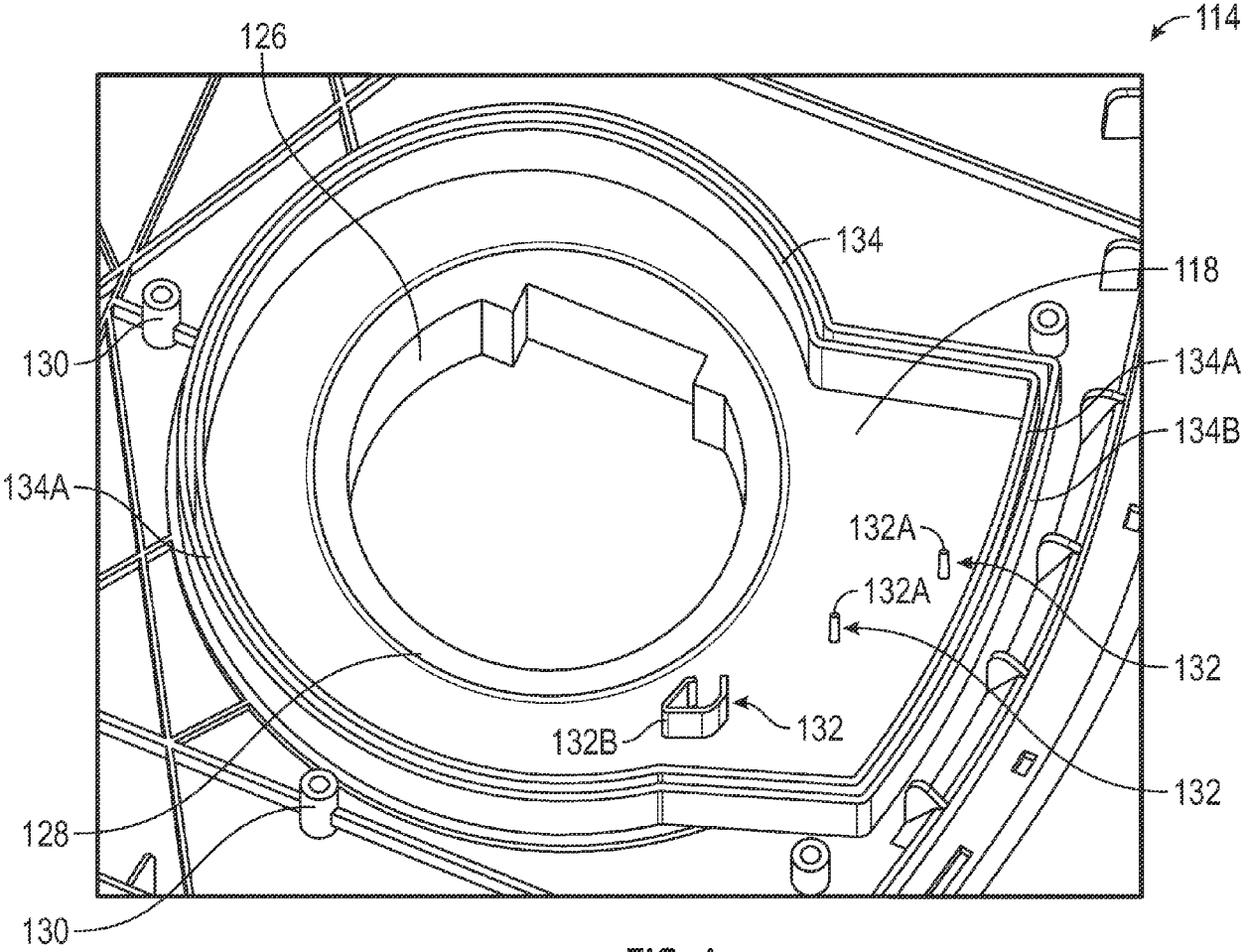
FIG. 4 illustrates an isometric bottom view an exemplary lid for use with a vacuum appliance illustrating a scroll base cavity in accordance with the present disclosure.
Figure 5:
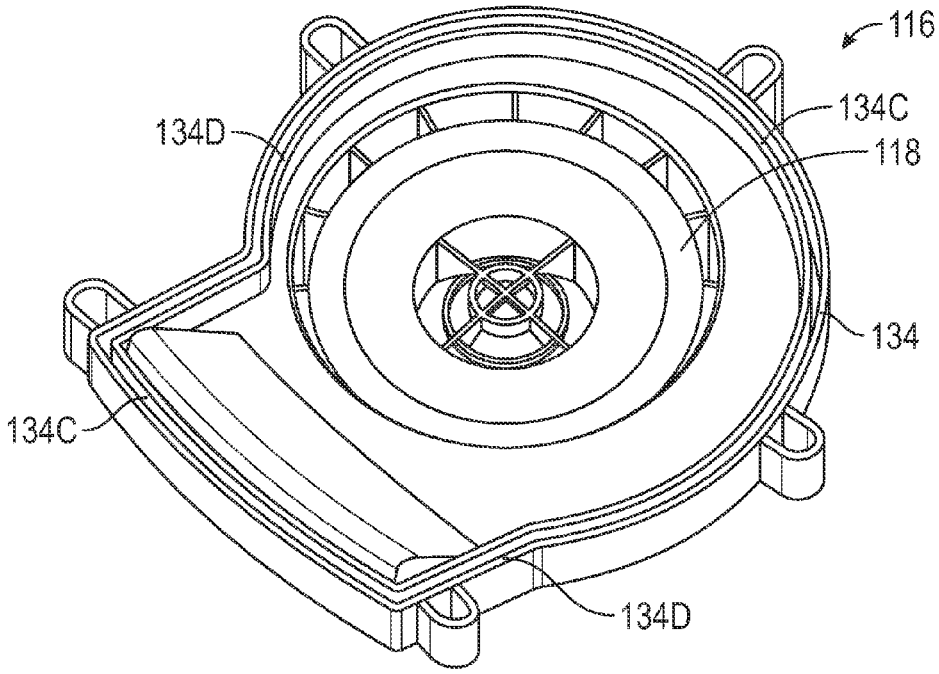
FIG. 5 illustrates an isometric bottom view of one of many embodiments of a scroll cover in accordance with the present disclosure.

FIG. 4 illustrates an isometric bottom view of one of many embodiments of scroll base 114 in accordance with the present disclosure. FIG. 5 is an isometric bottom view of one of many embodiments of scroll cover 116 in accordance with the present disclosure. FIGS. 4 and 5 will be described in conjunction with one another. Base 114 may be any shape or size required by a particular application and/or vacuum to which it will be associated, and may be contoured, such as to form at least a portion of cavity 118 when coupled with cover 116. Base 114 may include an opening 126, such as a hole or pocket, for communicating with one or more components of the system, such as vacuum motor 104, as further described below. Opening 126 may be any shape or size required by a particular application, and may preferably be configured to sealingly communicate with a particular vacuum motor utilized by a particular application, as will be understood by one of ordinary skill in the art. For example, base 114 may, but need not, include sealing structure 128 such as ribs or grooves, for sealingly communicating with vacuum motor 104 (see, e.g., FIG. 2), which may include one or more seals or gaskets there between. Base 114 may include one or more couplers 130, which may be any type of coupler required by a particular application, for coupling cover 116 thereto, such as by communicating with one or more fasteners 120, as described above. Base 114 may, but need not, include structure for holding or otherwise supporting one or more air flow splitters (see, e.g., FIG. 11), as will be further described below. For example, base 114 may include one or more mounts 132, which may include, for example, one or more posts 132A, walls 132B, or other structure for coupling an air flow splitter within cavity 118, which may be any structure required by a particular application, as will be understood by one of ordinary skill in the art. Base 114 may include at least a portion of a seal, such as, for example, a labyrinth seal 134, formed between base 114 and cover 116 when the two components are coupled to one another. For example, base 114 may include one or more channels 134A, which may, but need not, be formed between two ribs 134B, such as for communicating with complementary sealing structure on cover 116 (see, e.g., FIG. 5). As illustrated for exemplary purposes in FIG. 5, for example, cover 116 may include two or more channels 134C for receiving ribs 134B on base 114, and one or more ribs 134D for communicating with channel 134A on base 114. In this manner, one or more channels 134A, 134C and one or more ribs 134B, 134D may sealingly communicate with one another to form labyrinth seal 134 between base 114 and cover 116 when the base and cover are coupled together. As will be understood by one of ordinary skill having the benefits of the present disclosure, scroll assembly 100 may include any number of channels 134A, 134C and ribs 134B, 134D required by a particular application, each of which may be coupled to base 114 or cover 116 in any order required by a particular application. Each channel 134A, 134C or rib 134B, 134D may be any size required by a particular application, including without limitation having any length, depth or width, and may preferably be formed to create an air tight seal between base 114 and cover 116 when coupled to one another. Seal 134 may be formed along the entire periphery of scroll assembly 100, but need not be, and may alternatively be formed along one or more portions of the periphery, continuously or intermittently, as required by a particular application. Channels 134A, 134C and ribs 134B, 134D may be coupled to base 114 or cover 116 in any manner, including being formed integrally there with, in whole or in part.

Figure 6:
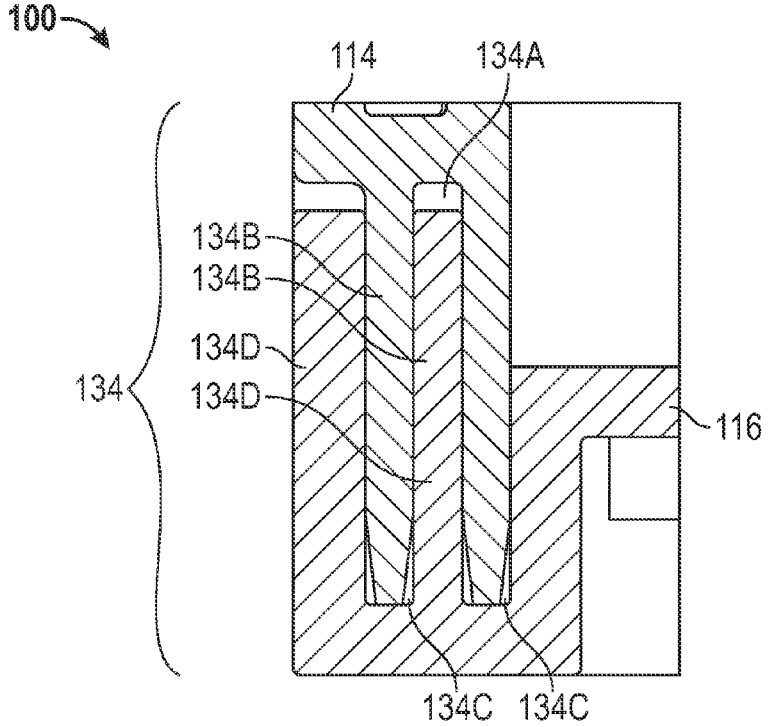
FIG. 6 illustrates a partial cross-sectional view of an exemplary labyrinth seal for a motor scroll assembly in accordance with the present disclosure.

FIG. 6 illustrates a cross-sectional view of one of many embodiments of motor scroll 100 having a labyrinth seal 134 in accordance with the present disclosure. As described above, labyrinth seal 134 may include one or more ribs 134B, 134D in sealing communication with one or more channels 134A, 134C such as when base 114 and cover 116 are coupled together. For example, a rib 134B, 134D and a corresponding channel 134A, 134C may, but need not, form an interference fit when coupled to one another, thereby interlocking to form an at least partially air-tight seal. Although a single channel 134A, 134C and complementary rib 134B, 134D may be utilized in one or more of many embodiments, seal 134 may preferably include a series of two or more interlocking channels 134A, 134C and ribs 134B, 134D (e.g., three are shown in FIG. 6 for illustrative purposes). Each complementary pair of channels 134A, 134C and ribs 134B, 134D may, but need not, be air-tight, and a series thereof may form an intricate combination of paths or passages that impede or eliminate the passage of fluid there through.

Figure 7:
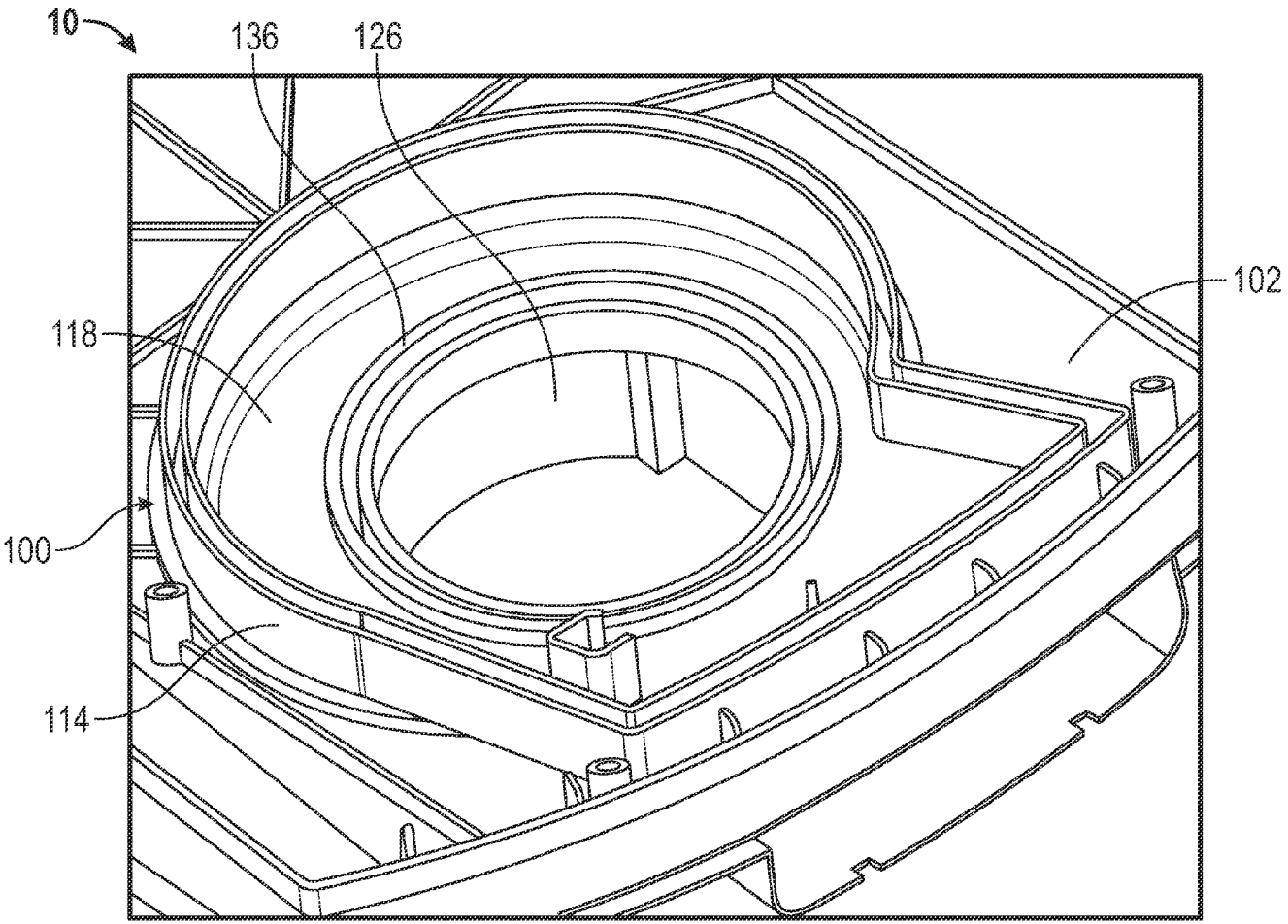
FIG. 7 illustrates an isometric bottom view of one of many embodiments of a lid of a vacuum cleaner having an upper motor gasket installed in accordance with the present disclosure.
Figure 8:
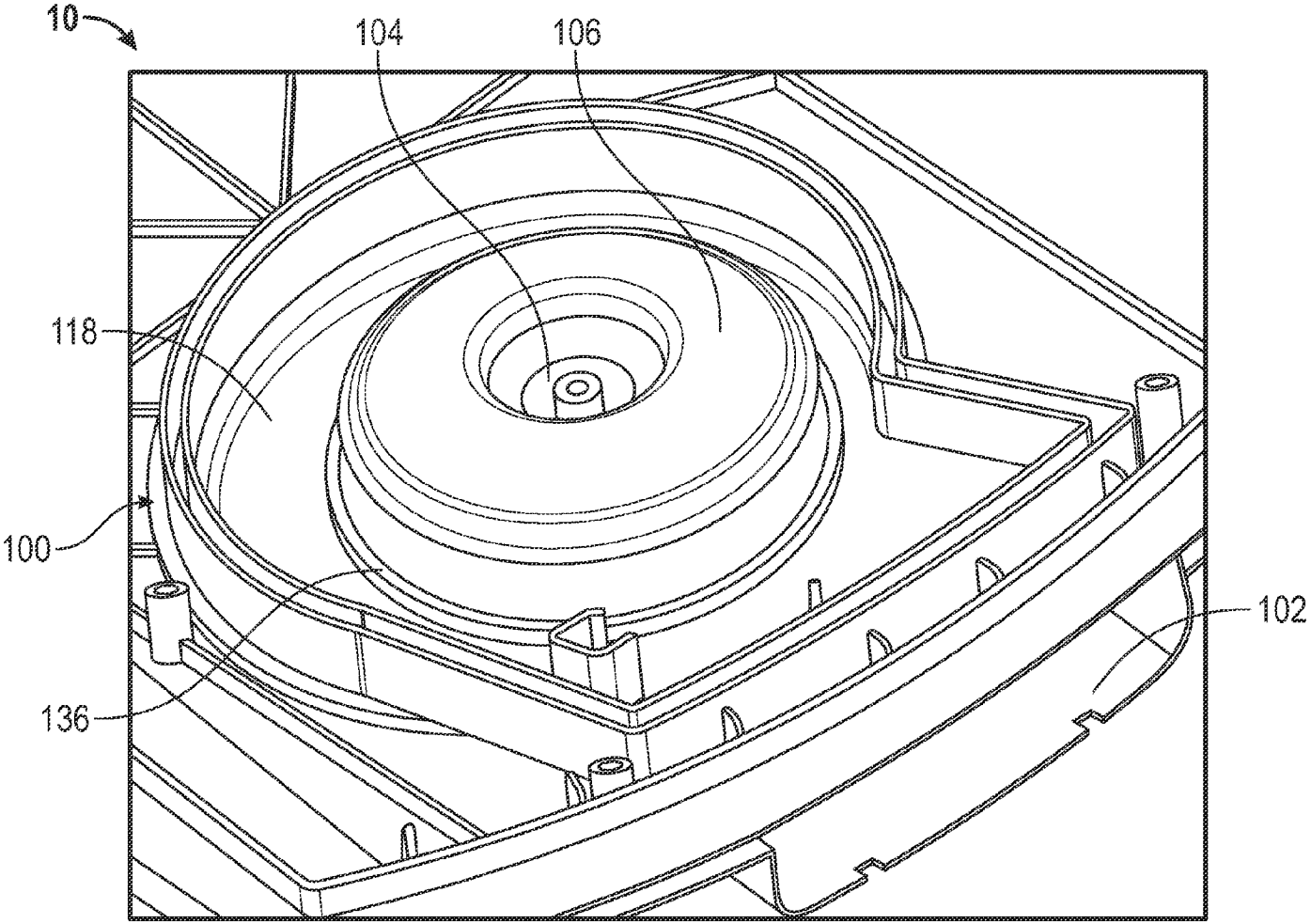
FIG. 8 illustrates an isometric bottom view of one of many embodiments of a lid of a vacuum cleaner having a vacuum motor installed in accordance with the present disclosure.
Figure 9:
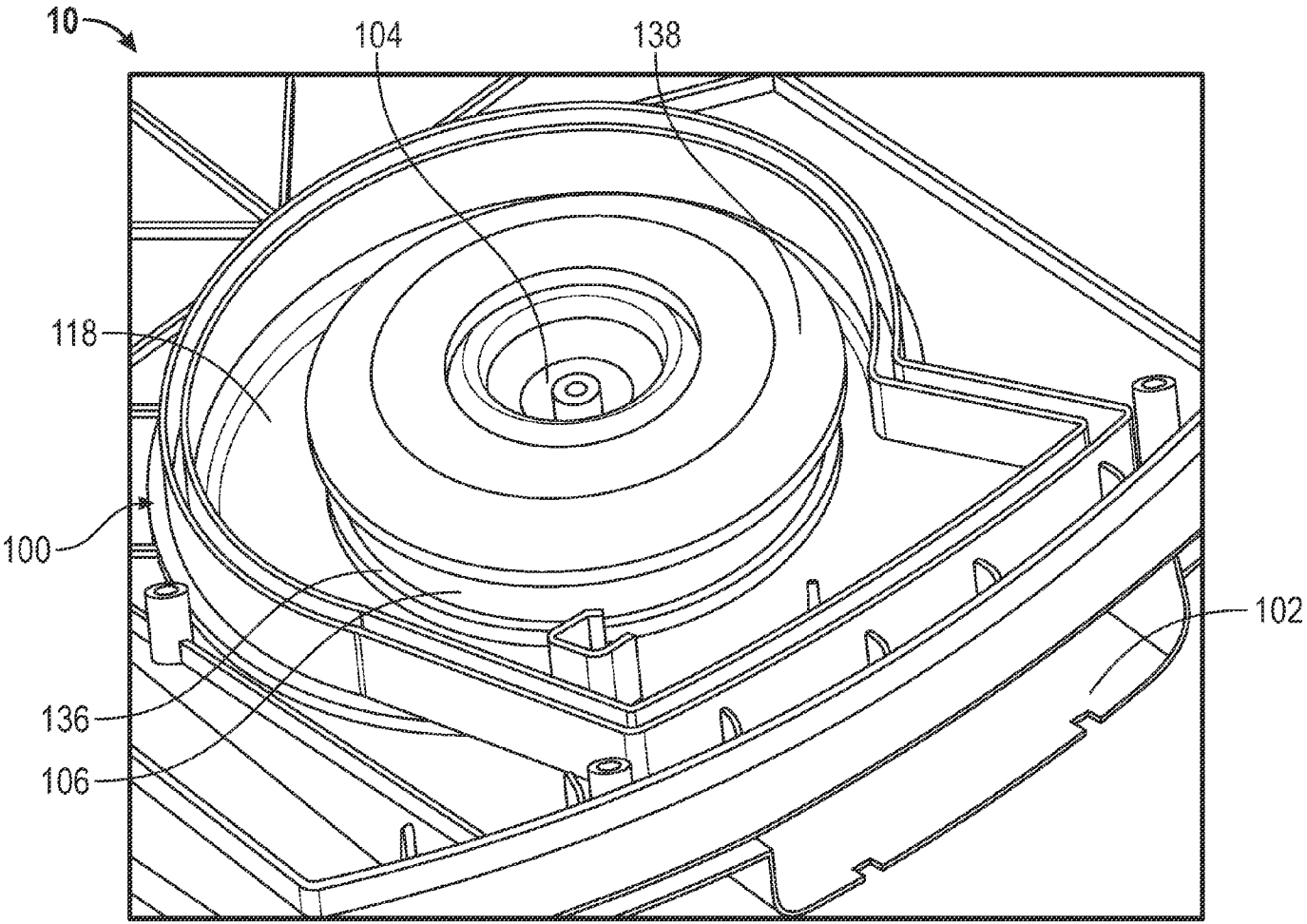
FIG. 9 illustrates an isometric bottom view of one of many embodiments of a lid of a vacuum cleaner having a motor vibration dampener installed in accordance with the present disclosure.

Turning now to FIG. 7, an isometric bottom view of one of many embodiments of lid 102 of vacuum cleaner 10 is illustrated, the lid 102 having an upper motor gasket 136 installed on its lower, bottom face (the face in contact with the collection drum 12) in accordance with the present disclosure. Alternatively, and equally acceptable, the assembly may be designed such that motor gasket 136 and the associated assemblies are installed on the upper face of lid 102, as appropriate. FIG. 8 is an isometric bottom view of one of many embodiments of lid 102 of vacuum cleaner 10 having a vacuum motor 104 installed in accordance with the present disclosure. FIG. 9 is an isometric bottom view of one of many embodiments of lid 102 of vacuum cleaner 10 having a motor vibration dampener 138 installed in accordance with the present disclosure. FIGS. 7-9 will be described in conjunction with one another. As described above, vacuum cleaner 10 may include a vacuum motor 104, which may be coupled at least partially within cavity 118. For example, motor 104 may be coupled with opening 126, and impeller assembly 106 may be at least partially disposed within cavity 118. In at least one embodiment, which is but one of many, vacuum cleaner 10 may include an upper motor gasket 136 disposed in cavity 118 of scroll 100, which may include being in sealing communication with sealing structure 128 (see, e.g., FIG. 4) about opening 126. Upper motor gasket 136 may be coupled between base 114 and impeller assembly 106, for example, to at least partially form an air-tight seal between cavity 118 and an atmosphere surrounding vacuum cleaner 10 (i.e., exterior of lid 102). Vacuum cleaner 10 may include a motor vibration dampener 138 coupled within cavity 118, such as to the bottom of impeller assembly 106. Dampener 138 may, but need not, form an at least partially air-tight seal between impeller assembly 138 and scroll cover 116, such as about air inlet 108 (see, e.g., FIG. 3), for example, when base 114 and cover 116 are coupled together. Dampener 138 may dampen, such as by deadening or absorbing, vibrations from motor 104 during vacuuming operations. Motor gasket 136 and vibration dampener 138 may be any shape or size required by a particular application, and may be formed from any appropriate material, such as plastic, silicone, rubber or equivalent elastomeric material, foamed rubber, or another material, separately or in combination. These components may be formed separately and coupled to vacuum cleaner 10, but need not be, and may alternatively be formed integrally therewith, such as with motor 104, including impeller assembly 106, lid 102, or a portion of scroll 100.

Figure 10:
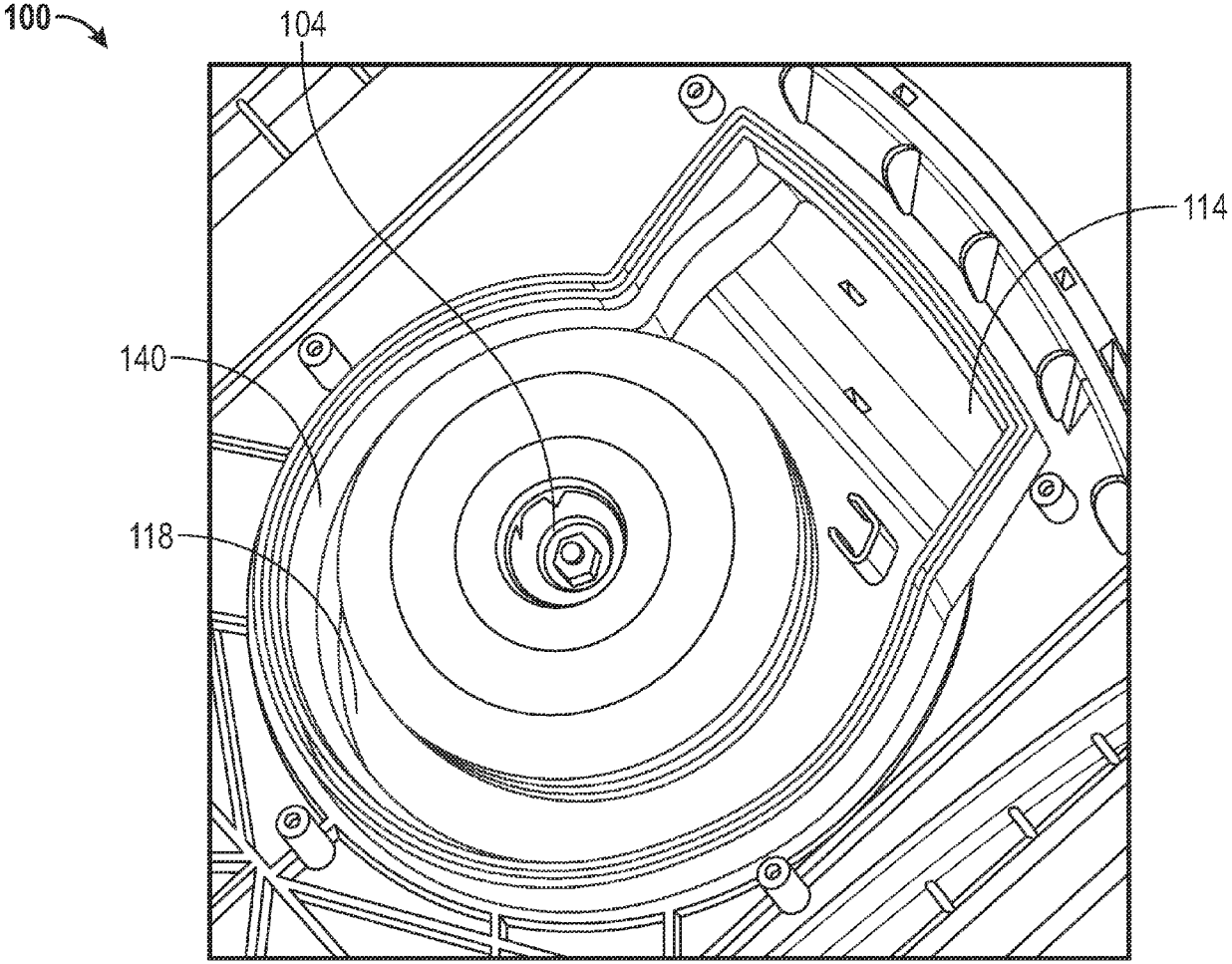
FIG. 10 illustrates an isometric bottom view of one of many embodiments of a motor scroll having a liner in accordance with the present disclosure.
Figure 11:
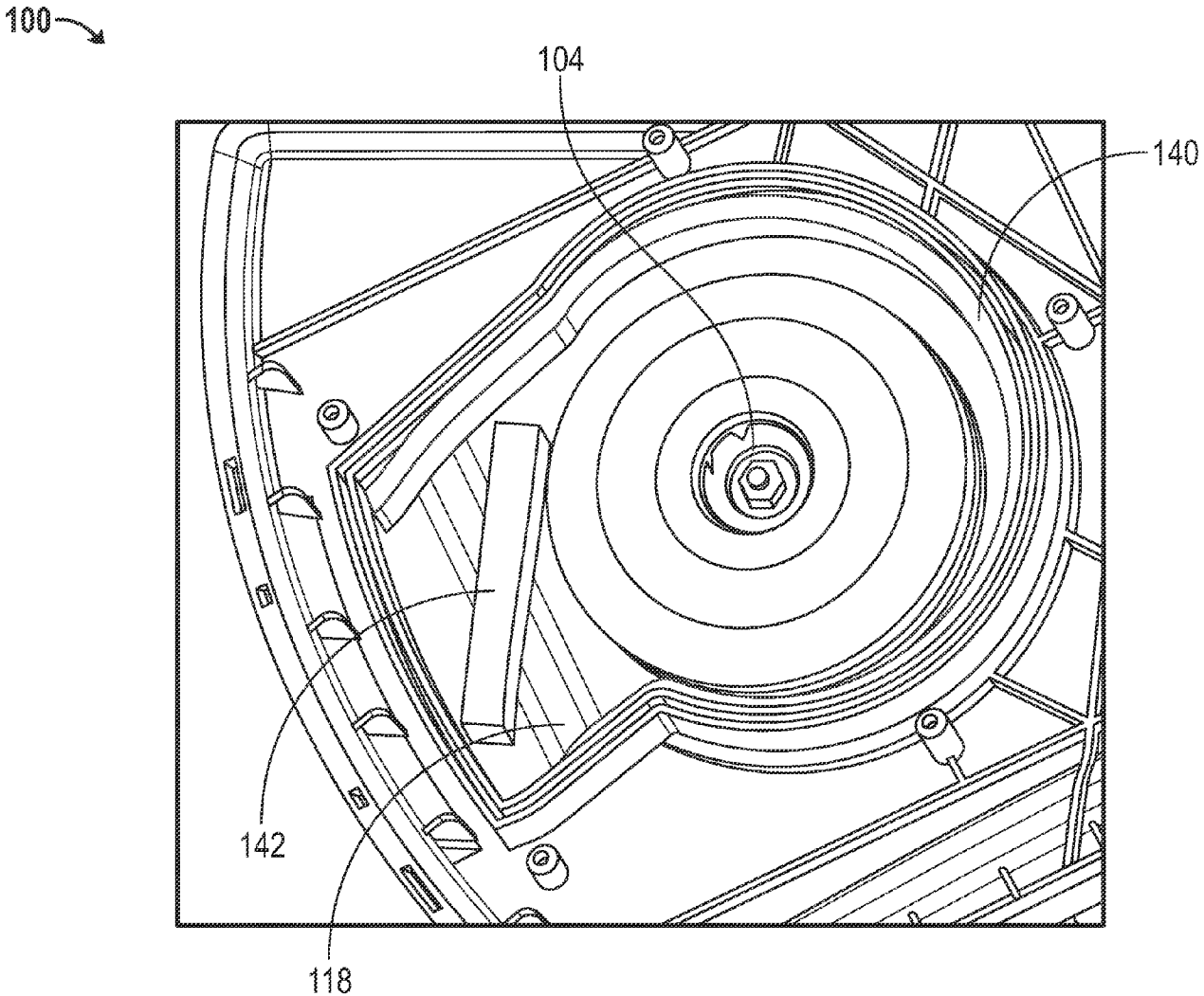
FIG. 11 illustrates an isometric bottom view of one of many embodiments of a motor scroll having a flow splitter in accordance with the present disclosure.

FIG. 10 is an isometric bottom view of one of many embodiments of motor scroll 100 having a liner 140 in accordance with the present disclosure. FIG. 11 is an isometric bottom view of one of many embodiments of motor scroll 100 having a flow splitter 142 in accordance with the present disclosure. FIGS. 10 and 11 will be described in conjunction with one another. Motor scroll 100 may, but need not, include a liner 140 coupled at least partially within cavity 118, for example, for at least partially absorbing or dampening noise emitted from motor 104 when energized. Liner 140 may be coupled anywhere within cavity 118, and may preferably be disposed about the periphery of cavity 118, in whole or in part. Liner 140 may be any size or shape required by a particular application, and may preferably be configured to contact both base 114 and cover 116 (see, e.g., FIG. 3) when the two components are coupled together. Liner 140 may be coupled to scroll 100 in any manner, which may include the use of fasteners (not shown), such as mechanical fasteners, adhesives (such as glues, epoxies, and the like), or other suitable fastening means. Motor scroll 100 may include a flow splitter 142 (FIG. 11) coupled within cavity 118, such as to mount 132 described above (see, e.g., FIG. 4). However, scroll 100 need not include mount 132, and flow splitter 142 may alternatively be coupled to scroll 100 using other fasteners, such as adhesives. Flow splitter 142 may be fluidicly coupled between air inlet 108 (e.g., FIG. 3) and exhaust port 112 (e.g., FIG. 2) for at least partially splitting or dividing airflow across exhaust port 112. For example, in at least one embodiment, which is but one of many, flow splitter 142 may be oriented at such an angle relative and/or orthogonal to the central axis of motor 104 so as to equally divide exiting airflow for even distribution across exhaust port 112, which may thereby result in lower exhaust air velocities and/or less noise from the air exiting exhaust port 112. Separately or in combination with dividing air flow, flow splitter 142 may act as a barrier, such as by absorbing or deflecting sound from vacuum motor 104, which can, but need not, at least partially lower the amount of noise emitted by a vacuum cleaner during operations. Liner 140 and flow splitter 142 may be formed from any material required by a particular application, such as plastic, rubber, foam, or another material, separately or in combination. In at least one embodiment, which is but one of many, one or both of these components may be formed from sound absorbing foam. The sound absorbing foam may be used for absorbing sound, reducing noise, echo, and/or reverberation from motor 104 during operation of the vacuum appliance. Suitable sound absorbing/sound deadening foams for use with the present invention include, but are not limited to, polyurethane foams, melamine foams, rockwool, formed recycled materials, and combinations thereof, in either open- or closed-cell form, and of varying density.

Other and further embodiments utilizing one or more aspects of the inventions described above can be devised without departing from the spirit of Applicant's invention. For example, a motor scroll in accordance with the present disclosure may be adapted for use with machines other than vacuum cleaners, which may include any fluid machine having a motor, such as a blower, pump, engine, or other machine. Further, the various methods and embodiments of the motor scroll can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The present invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to fully protect all such modifications and improvements that come within the scope or range of equivalent of the following claims.

What is claimed is:

1. A scroll assembly for a vacuum appliance, comprising:
- a base portion having an opening there through;
- a cover portion having an air inlet and configured to couple to the base portion, thereby defining a cavity between the base portion and the cover portion; and,
- a flow splitter coupled within the cavity;
- wherein the cover portion and the base portion collectively form a labyrinth seal when the cover portion and the base portion are coupled together; and
- wherein the labyrinth seal at least partially circumscribes the cavity.

2. The scroll assembly of claim 1, wherein one of the scroll and cover portions includes a channel having two walls, and wherein the other of the scroll and cover portions includes a rib configured to sealingly engage the channel.

3. The scroll assembly of claim 2, further comprising a plurality of ribs configured to sealingly engage the channel.

4. The scroll assembly of claim 1, wherein the opening is configured to couple with a vacuum motor.

5. The scroll assembly of claim 1, further comprising a sound-deadening barrier coupled within the cavity and disposed radially interior of the labyrinth seal, the barrier at least partially circumscribing the opening in the base portion.

6. A vacuum appliance, comprising:
- a lid adapted to couple to a collection drum, the lid having an interior side, an exterior side, and an exhaust port there through;
- a scroll assembly as claimed in claim 1 coupled to the lid so that the air inlet is in fluid communication with the exhaust port; and
- a vacuum motor coupled to the lid, the vacuum motor having an impeller assembly disposed at least partially within the cavity of the scroll assembly.

7. The vacuum appliance of claim 6, further comprising a collection drum coupled to the interior side of the lid and wherein the scroll assembly is at least partially disposed inside the collection drum.

8. The vacuum appliance of claim 6, wherein the vacuum appliance is a wet/dry vacuum appliance.

9. A method of exhausting air from a vacuum appliance as claimed in claim 6 and having a flow splitter coupled within the cavity and fluidicly disposed between the air inlet of the cover portion and the exhaust port of the lid, the method comprising:
- energizing the vacuum motor, thereby drawing air through the air inlet of the cover portion and into the cavity of the scroll assembly;
- allowing the air to contact the flow splitter, thereby distributing the air into a plurality of flow paths; and
- allowing the air to exit the vacuum appliance through the exhaust port.

10. The method of claim 9, further comprising distributing the air into a plurality of substantially equal flow paths across the exhaust port.

11. A vacuum appliance comprising:
- a collection drum having at least one side, a base, and an open top;
- a motor operable to create a vacuum in the collection drum;
- a lid removably attached to the open top of the collection drum, the lid having a motor mount member with the motor attached thereto, and a scroll assembly attached to the lid, the scroll assembly comprising:
- a base portion having an opening formed there through;
- a cover portion having an air inlet and configured to couple to the base portion, thereby defining a cavity between the base portion and the cover portion;
- wherein the cover portion and the base portion collectively form a labyrinth seal when the cover portion and the base portion are coupled together; and
- wherein the labyrinth seal at least partially circumscribes the cavity.

12. The vacuum appliance of claim 11, wherein the vacuum motor has an impeller assembly disposed at least partially within the cavity of the scroll assembly.

13. The vacuum appliance of claim 11, wherein the collection drum includes a drain opening extending therethrough a wall of the drum.

14. The vacuum appliance of claim 11, wherein the opening in the base portion of the scroll assembly is sized to accept a shaft extending therethrough.

15. The vacuum appliance of claim 11, further comprising a blower wheel, wherein the motor includes a shaft having the blower wheel attached thereto.

16. The vacuum appliance of claim 11, further comprising a filter assembly attached to a face of the lid and extending downwardly into the collection drum.

17. The vacuum appliance of claim 11, further comprising a motor gasket sized to seal an interface between a section of the lid and the motor to prevent air flow from escaping through an aperture, such as a shaft aperture.

18. The vacuum appliance of claim 11, wherein the scroll assembly further comprises an air flow splitter oriented to divide the air flow during vacuum operation across the exhaust port.

19. The vacuum appliance of claim 18, wherein the air flow splitter is made of a sound absorbing material.

* * * * *